US010072492B2

(12) United States Patent
DiGiovanni

(10) Patent No.: US 10,072,492 B2
(45) Date of Patent: Sep. 11, 2018

(54) SENSOR-ENABLED CUTTING ELEMENTS FOR EARTH-BORING TOOLS, EARTH-BORING TOOLS SO EQUIPPED, AND RELATED METHODS

(71) Applicant: Baker Hughes Incorporated, Houston, TX (US)

(72) Inventor: Anthony A. DiGiovanni, Houston, TX (US)

(73) Assignee: Baker Hughes Corporation, Houston, TX (US)

( * ) Notice: Subject to any disclaimer, the term of this patent is extended or adjusted under 35 U.S.C. 154(b) by 0 days.

(21) Appl. No.: 15/295,553

(22) Filed: Oct. 17, 2016

(65) Prior Publication Data

US 2017/0030185 A1 Feb. 2, 2017

Related U.S. Application Data

(63) Continuation of application No. 13/610,123, filed on Sep. 11, 2012, now Pat. No. 9,500,070.

(Continued)

(51) Int. Cl.
*E21B 47/01* (2012.01)
*E21B 10/55* (2006.01)

(Continued)

(52) U.S. Cl.
CPC ..... *E21B 47/01* (2013.01); *E21B 10/50* (2013.01); *E21B 10/52* (2013.01); *E21B 10/55* (2013.01);

(Continued)

(58) Field of Classification Search
CPC ..... E21B 12/02; E21B 47/01; E21B 47/011; E21B 10/46–10/58; E21B 10/60;

(Continued)

(56) References Cited

U.S. PATENT DOCUMENTS 4,785,894 A 11/1988 Davis, Jr. et al.
5,176,053 A 1/1993 Alvelid et al.

(Continued)

FOREIGN PATENT DOCUMENTS

WO 2010054353 A2 5/2010

OTHER PUBLICATIONS

American Heritage Dictionary definition: within. (n.d.) American Heritage® Dictionary of the English Language, Fifth Edition. (2011 ). Retrieved Feb. 11, 2016 from http://www.thefreedictionary.com/within.

(Continued)

*Primary Examiner* — Wei Wang
(74) *Attorney, Agent, or Firm* — TraskBritt

(57) ABSTRACT

Sensor-enabled cutting elements for an earth-boring drilling tool may comprise a substrate base, and a cutting tip at an end of the substrate base. The cutting tip may comprise a tapered surface extending from the substrate base and tapering to an apex of the cutting tip, and a sensor coupled with the cutting tip. The sensor may be configured to obtain data relating to at least one parameter related to at least one of a drilling condition, a wellbore condition, a formation condition, and a condition of the earth-boring drilling tool. The sensor-enabled cutting elements may be included on at least one of an earth-boring drill bit, a drilling tool, a bottom-hole assembly, and a drill string.

20 Claims, 6 Drawing Sheets

Related U.S. Application Data

(60) Provisional application No. 61/536,270, filed on Sep. 19, 2011.

(51) Int. Cl.

| | |
|---|---|
| ***E21B 10/567*** | (2006.01) |
| ***E21B 10/52*** | (2006.01) |
| ***E21B 10/50*** | (2006.01) |
| ***E21B 10/60*** | (2006.01) |
| ***E21B 47/00*** | (2012.01) |
| ***E21B 47/024*** | (2006.01) |
| ***E21B 47/06*** | (2012.01) |
| ***E21B 12/00*** | (2006.01) |

(52) U.S. Cl.
CPC ..... *E21B 10/567* (2013.01); *E21B 10/60* (2013.01); *E21B 12/00* (2013.01); *E21B 47/0006* (2013.01); *E21B 47/024* (2013.01); *E21B 47/06* (2013.01); *E21B 47/065* (2013.01); *Y10T 29/49002* (2015.01)

(58) Field of Classification Search
CPC .... E21B 12/00; E21B 47/0006; E21B 47/024; E21B 47/06; E21B 47/065; Y10T 29/49002
See application file for complete search history.

(56) References Cited

U.S. PATENT DOCUMENTS

| | | | | |
|---|---|---|---|---|
| 5,438,860 | A | 8/1995 | Kawai et al. | |
| 7,604,072 | B2 | 10/2009 | Pastusek et al. | |
| 8,746,367 | B2 | 6/2014 | DiGiovanni et al. | |
| 2007/0272442 | A1* | 11/2007 | Pastusek | E21B 21/08 175/40 |
| 2008/0314647 | A1 | 12/2008 | Hall et al. | |
| 2010/0089645 | A1 | 4/2010 | Trinh et al. | |
| 2011/0155472 | A1 | 6/2011 | Lyons et al. | |
| 2011/0180324 | A1 | 7/2011 | Hall et al. | |
| 2011/0186290 | A1* | 8/2011 | Roddy | E21B 43/25 166/253.1 |
| 2011/0266054 | A1 | 11/2011 | Kumar et al. | |
| 2011/0266055 | A1 | 11/2011 | DiGiovanni et al. | |
| 2011/0266058 | A1 | 11/2011 | Kumar et al. | |
| 2012/0031674 | A1 | 2/2012 | Lyons | |
| 2012/0325564 | A1 | 12/2012 | Vaughn et al. | |
| 2013/0068525 | A1 | 3/2013 | DiGiovanni | |
| 2013/0220706 | A1 | 8/2013 | Azar et al. | |
| 2013/0270890 | A1 | 10/2013 | Hall | |
| 2014/0047776 | A1 | 2/2014 | Scott et al. | |
| 2014/0198827 | A1* | 7/2014 | Liversage | G01K 7/16 374/185 |

OTHER PUBLICATIONS

Digiovanni et al., U.S. Appl. No. 61/623,042, filed Apr. 11, 2012, and entitled Apparatuses and Methods for At-Bit Resistivity Measurements for an Earth-Boring Drilling Tool.
Robertson, Diamond-Like amorphous carbon, Materials Science and Engineering: R 37 (2002), pp. 129-281.
Scott, U.S. Appl. No. 61/418,217, filed Nov. 30, 2010, and entitled Cutter with Diamond Sens for Acquiring Information Relating to an Earth-Boring Drilling Tool.
International Search Report for International Application No. PCT/US2012/055841 dated Feb. 26, 2017, 3 pages.
International Written Opinion for International Application No. PCT/US2012/055841 dated Feb. 26, 2017, 8 pages.

* cited by examiner

SENSOR-ENABLED CUTTING ELEMENTS FOR EARTH-BORING TOOLS, EARTH-BORING TOOLS SO EQUIPPED, AND RELATED METHODS

CROSS-REFERENCE TO RELATED APPLICATIONS

This application is a continuation of U.S. patent application Ser. No. 13/610,123, filed Sep. 11, 2012, now U.S. Pat. No. 9,500,070, issued Nov. 22, 2016, and claims the benefit of U.S. Provisional Patent Application Ser. No. 61/536,270, filed Sep. 19, 2011, and entitled, Sensor Enabled Cutting Elements for Earth-Boring Tools, Earth-Boring Tools So Equipped, and Related Methods, the disclosure of each of which is hereby incorporated herein in its entirety by this reference.

TECHNICAL FIELD

The present disclosure generally relates to earth-boring tools, and cutting elements attached thereto. More particularly, embodiments of the present disclosure relate to sensor-enabled cutting elements for an earth-boring tool.

BACKGROUND

Earth-boring tools are commonly used for forming (e.g., drilling and reaming) bore holes or wells (hereinafter "wellbores") in earth formations. Earth-boring tools include, for example, rotary drill bits, core bits, eccentric bits, bicenter bits, reamers, underreamers, and mills.

The oil and gas industry expends sizable sums to design cutting tools, such as downhole drill bits including roller cone bits and fixed-cutter bits, which have relatively long service lives, with relatively infrequent failure. In particular, considerable sums are expended to design and manufacture roller cone bits and fixed-cutter bits in a manner that minimizes the opportunity for catastrophic drill bit failure during drilling operations. The loss of a roller cone or a cutting element from a fixed-cutter bit during drilling operations can impede the drilling operations and, at worst, necessitate rather expensive fishing operations.

Diagnostic information related to a drill bit and certain components of the drill bit may be linked to the durability, performance, and the potential failure of the drill bit. Recent advances have been made in obtaining real-time performance data during rock cutting. The inventor has appreciated a need in the art for improved apparatuses and methods for obtaining measurements related to the diagnostic and actual performance of a cutting element of an earth-boring tool. In addition, the inventor has appreciated a need in the art for improved apparatuses and methods of receiving additional measurements of various parameters during drill bit operations.

BRIEF DESCRIPTION OF THE SEVERAL VIEWS OF THE DRAWINGS

While the specification concludes with claims particularly pointing out and distinctly claiming what are regarded as embodiments of the present invention, various features and advantages of this invention may be more readily ascertained from the following description of example embodiments of the invention provided with reference to the accompanying drawings, in which:

DETAILED DESCRIPTION

Figure 1C:
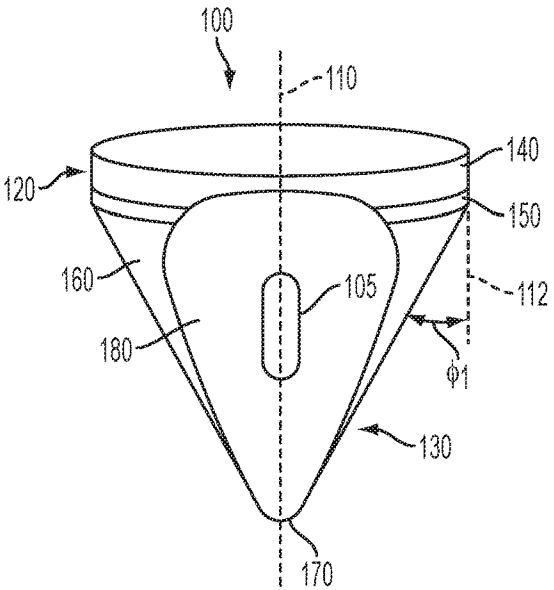
FIGS. 1A, 1B, and 1C are various views of a cutting element according to an embodiment of the present disclosure.

The illustrations presented herein are not meant to be actual views of any particular cutting element, earth-boring tool, or portion of a cutting element or earth-boring tool, but are merely idealized representations that are employed to describe embodiments of the present disclosure. Additionally, elements common between figures may retain the same or similar numerical designation.

It will be readily apparent to one of ordinary skill in the art that the present disclosure may be practiced by numerous other partitioning solutions. Those of ordinary skill in the art would understand that information and signals may be represented using any of a variety of different technologies and techniques. For example, data, instructions, commands, information, signals, bits, and symbols that may be generated and/or received by a sensor-enabled cutting element may be represented by voltages, currents, electromagnetic waves, magnetic fields or particles, optical fields or particles, or any combination thereof. It will be understood by a person of ordinary skill in the art that a signal may include a bus of signals, wherein the bus may have a variety of bit widths and the present disclosure may be implemented on any number of data signals including a single data signal.

The various illustrative logical blocks, modules, and circuits described in connection with the embodiments disclosed herein may be implemented or performed with a general-purpose processor, a special-purpose processor, a Digital Signal Processor (DSP), an Application-Specific Integrated Circuit (ASIC), a Field-Programmable Gate Array (FPGA) or other programmable logic device, discrete gate or transistor logic, discrete hardware components, or any combination thereof designed to perform the functions described herein. A general-purpose processor may be a microprocessor, but in the alternative, the processor may be any conventional processor, controller, microcontroller, or state machine. A general-purpose processor may be considered a special-purpose processor while the general-purpose processor executes instructions (e.g., software code) stored on a computer-readable medium. A processor may also be implemented as a combination of computing devices, such as a combination of a DSP and a microprocessor, a plurality of microprocessors, one or more microprocessors in conjunction with a DSP core, or any other such configuration. A computer-readable medium may include storage media, such as ROMs, EPROMs, EEPROMs, Flash memories, optical disks, and other storage devices.

It should be understood that any reference to an element herein using a designation such as "first," "second," and so forth does not limit the quantity or order of those elements, unless such limitation is explicitly stated. Rather, these designations may be used herein as a convenient method of distinguishing between two or more elements or instances of an element. Thus, a reference to first and second elements does not mean that only two elements may be employed there or that the first element must precede the second element in some manner. In addition, unless stated otherwise, a set of elements may comprise one or more elements.

As used herein, the term "polycrystalline material" means and includes any material comprising a plurality of grains or crystals of the material that are bonded directly together by inter-granular bonds. The crystal structures of the individual grains of the material may be randomly oriented in space within the polycrystalline material.

As used herein, the term "polycrystalline compact" means and includes any structure comprising a polycrystalline material formed by a process that involves application of pressure (e.g., compaction) to the precursor material or materials used to form the polycrystalline material.

As used herein, the term "hard material" means and includes any material having a Knoop hardness value of about 3,000 $Kg_f/mm^2$ (29,420 MPa) or more. Hard materials include, for example, diamond and cubic boron nitride.

As used herein, the terms "drill bit" and "earth-boring tool" each mean and include any type of bit or tool used for drilling during the formation or enlargement of a wellbore in subterranean formations and includes, for example, fixed-cutter bits, rotary drill bits, percussion bits, core bits, eccentric bits, bi-center bits, reamers, mills, drag bits, roller cone bits, diamond-impregnated bits, hybrid bits (which may include, for example, both fixed-cutters and rolling cutters) and other drilling bits and tools known in the art.

As used herein, the term "cutting element," when referring to a sensor-enabled structure generally configured as a cutting element, does not require or imply that the structure shears, gouges or crushes subterranean formation material during operation of the earth-boring tool to which such structure is secured, unless the context of the description of the structure necessarily dictates that such contact may, or will, occur.

The earth-boring drill bit may be coupled, either directly or indirectly, to an end of what is referred to in the art as a "drill string," which comprises a series of elongated tubular segments connected end-to-end that extends into the wellbore from the surface of the formation. Various tools and components, including the earth-boring drill bit, may be coupled together at the distal end of the drill string at the bottom of the wellbore being drilled. This assembly of tools and components is referred to in the art as a "bottom-hole assembly" (BHA).

In operation, the earth-boring drill bit may be rotated within the wellbore by rotating the drill string from the surface of the formation, or the earth-boring drill bit may be rotated by coupling the earth-boring drill bit to a downhole motor, which is also coupled to the drill string and disposed proximate the bottom of the wellbore. The downhole motor may comprise, for example, a hydraulic Moineau-type motor having a drive shaft, to which the earth-boring drill bit is attached. The drive shaft may be caused to rotate by pumping fluid (e.g., drilling mud or fluid) from the surface of the formation down through the center of the drill string, through the hydraulic motor, out from nozzles in the earth-boring drill bit, and back up to the surface of the formation through the annular space between the outer surface of the drill string and the exposed surface of the formation within the wellbore. As a result, the earth-boring drill bit is rotated and advanced into the subterranean formation, such as through the cutters or other abrasive structures thereof cutting, crushing, shearing, and/or abrading away the subterranean formation material to form the wellbore.

Figure 1B:
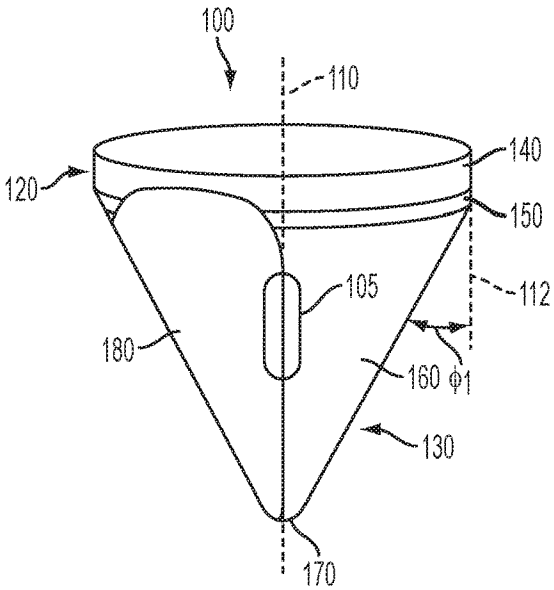
Figure 1A:
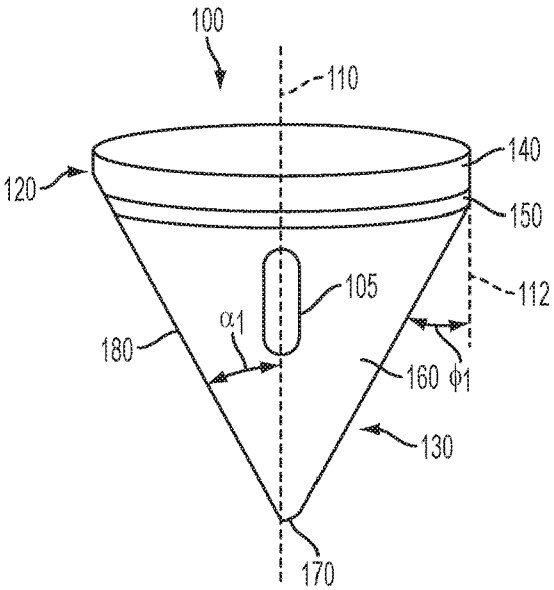

FIGS. 1A, 1B, and 1C are various views of a cutting element 100 according to an embodiment of the present disclosure. The cutting element 100 includes a substrate base 120, and a cutting tip 130. The substrate base 120 may have a generally cylindrical shape. The substrate base 120 may include, for example, a cemented carbide material, such as a tungsten-carbide material. The cutting tip 130 may include a hard material, such as, for example, polycrystalline diamond, diamond-like carbon, or cubic boron nitride. The hard material may comprise substantially the entire cutting tip 130 or comprise a coating over another material, for example, a cemented carbide member protruding from the substrate base 120 and forming a portion thereof.

A longitudinal axis 110 may extend approximately through a center of the substrate base 120 in an orientation that may be at least substantially parallel to a lateral side surface 140 of the substrate base 120 (e.g., in an orientation that may be perpendicular to a generally circular cross-section of the substrate base 120). The lateral side surface 140 of the substrate base 120 may be coextensive and continuous with a generally cylindrical lateral side surface 150 of the cutting tip 130.

Of course, it is contemplated that non-cylindrical substrate bases for cutting elements 100 may be employed; for example, the substrate base 120 may be oval, elliptical, or of polygonal configuration, taken in lateral cross-section. Furthermore, the cross-section of the substrate base 120 may vary along its length and comprise, for example, a frusto-conical substrate to facilitate insertion into a pocket in a blade or roller cone of an earth-boring tool. Accordingly, in some such instances, the longitudinal axis 110 may not necessarily be parallel with a lateral side surface 140 of substrate base 120. Positioning of the cutting element 100, according to embodiments of the disclosure, when contact with a subterranean formation is desired or contemplated, may entail positioning (such term including orientation of cutting element 100) such that force from such contact is applied against cutting tip 130 and substantially through longitudinal axis 110 of the cutting element 100 so as to substantially eliminate bending, shear and torsional force components on cutting element 100 and a sensor, as described below, disposed within cutting element 100.

The cutting tip 130 includes a tapered surface 160 that tapers toward an apex 170 of the cutting tip 130. In other words, the tapered surface 160 may extend from the generally cylindrical lateral side surface 150 to the apex 170. For example, the tapered surface 160 may be a generally conical surface, an ogive surface, or have another tapered shape. Thus, in some embodiments the apex 170 of the cutting tip 130 may be focused to a point, while in other embodiments the apex 170 of the cutting tip 130 may be generally rounded. The location of the apex 170 may be centered about the longitudinal axis 110.

The cutting tip 130 may include a cutting surface 180. The cutting surface 180 may extend from a location at least substantially proximate the apex 170 to a location on the cutting element 100 at a selected or predetermined distance from the apex 170, such that an angle $\alpha_1$ between the longitudinal axis 110 and the cutting surface 180 may be within a range of from about fifteen degrees (15°) to about ninety degrees (90°). Portions of the cutting tip 130, such as the cutting surface 180, may be polished.

The tapered surface 160 may be defined by an angle $\Phi_1$ existing between the tapered surface 160 and a phantom line 112 extending from the generally cylindrical lateral side surface 150 of the cutting tip 130. The angle $\Phi_1$ may be within a range of from about thirty degrees) (30° to about sixty degrees (60°). In FIGS. 1A, 1B, and 1C, the angle $\Phi_1$ is about thirty degrees) (30°, the apex 170 of the cutting tip 130 is centered about the longitudinal axis 110, and the cutting surface 180 extends from the apex 170 to the lateral side surface 140 of the substrate base 120. In turn, the angle $\alpha_1$ is less than thirty degrees (30°).

The cutting surface 180 may include a flat portion relative to the rest of the tapered surface 160 of the cutting tip 130. For example, FIG. 1B shows the cutting element 100 taken from a viewpoint rotated approximately forty-five degrees (45°) clockwise of that of FIG. 1A, and FIG. 1C shows the cutting element 100 taken from a viewpoint rotated approximately ninety degrees (90°) clockwise of that of FIG. 1A. The viewpoints of FIGS. 1B and 1C show the cutting surface 180 having a flat portion. As further shown in FIGS. 1B and 1C, the cutting element 100 may be symmetrical about the longitudinal axis 110 for some viewpoints, and non-symmetrical for other viewpoints. In some embodiments, the cutting element may 100 may be substantially symmetrical about the longitudinal axis 110 along all viewpoints. Such symmetry may enable, with appropriate positioning of cutting element 100, substantial elimination of torsional, shear and bending stresses on cutting element 100 during operation of an earth-boring tool to which cutting element 100 is mounted. For example, during drilling operations, the earth-boring drill bit may experience "whirling," in which the earth-boring drill bit may temporarily move in the reverse direction. Having a cutting element 100 having a generally conical shape that is axi-symmetrical may reduce damage to the cutting element 100 because forces may be applied to the cutting element 100 that are approximately the same in either direction.

Other configurations and shapes of the cutting element 100 are contemplated that include the tapered surface of the cutting tip 130. Examples of such additional configurations and shapes may include those described in U.S. patent application Ser. No. 13/204,459, which was filed Aug. 5, 2011, now U.S. Pat. No. 9,022,149, issued May 5, 2015, and entitled "Shaped Cutting Elements for Earth-Boring Tools, Earth-Boring Tools Including Such Cutting Elements and Related Methods," the entire disclosure of which is incorporated herein by this reference.

The cutting element 100 may further include a sensor 105 coupled therewith. Therefore, the cutting element 100 may be a "sensor-enabled" cutting element. A sensor-enabled cutting element may also be referred to herein as an "instrumented" cutting element. The sensor 105 may be coupled with at least one of the substrate base 120 and the cutting tip 130. The cutting element 100 may include one or more integrated circuits configured to measure various parameters related to drilling conditions, wellbore conditions, formation conditions and/or performance of the earth-boring drill bit. Knowledge of the drilling conditions, formation conditions, wellbore conditions or performance of the earth-boring drill bit may be used to adjust drilling parameters (e.g., weight-on-bit or RPM), evaluate the effectiveness of the cutting action of the earth-boring drill bit, estimate the life of the earth-boring drill bit for replacement, or contribute to a determination as to other necessary or desirable actions.

At least some of the sensors described herein may include a transducer. A transducer may be defined as a device actuated by power from one system and supplying power in the same or any other form to a second system. This definition is intended to include sensors that provide an electrical signal in response to a measurement (e.g., radiation) as well as devices that use electric power to produce mechanical motion. The transducer may be configured to provide a signal indicative of various parameters, such as properties of fluids in the wellbore, properties of earth formations, and/or properties of fluids in earth formations. In some embodiments, the sensor 105 may include a piezoelectric material. The use of the piezoelectric material may contribute to measuring the strain on the cutting element 100 during drilling operations. When strain is to be measured, placement of the sensor 105 may be varied so as to be responsive to stress along longitudinal axis 110, or offset from longitudinal axis 110. Similarly, as noted above, selective positioning of cutting element 100 on an earth-boring tool may be employed to facilitate determination of one or more force components stressing the cutting element 100.

In some embodiments, the sensor 105 may include electrical pads to measure the electrical potential of the adjoining formation or to investigate high-frequency (HF) attenuation. In some embodiments, the sensor 105 may include one or more ultrasonic transducers, such as an array of ultrasonic transducers configured for determining desired parameters through methods such as acoustic imaging, acoustic velocity determination, acoustic attenuation determination, and shear wave propagation.

In some embodiments, the sensor 105 may include sensors that are configured to measure physical properties of the cutting element 100. For example, the sensor 105 may include accelerometers, gyroscopes, inclinometers, microelectromechanical systems (MEMS), nanoelectromechanical system (NEMS) style sensors, and related signal conditioning circuitry. Such sensors 105 may be coupled with the cutting element 100, such as within the cutting element 100 or on the surface of the cutting element 100.

In some embodiments, the sensor 105 may include chemical sensors configured for elemental analysis of conditions (e.g., fluids) within the wellbore. For example, the sensor 105 may include carbon nanotubes (CNTs), complementary-metal oxide semiconductor (CMOS) sensors configured to detect the presence of various trace elements based on the principle of selectively gated field effect transistors (FETs) or ion sensitive field effect transistors (ISFETs) for pH, $H_2S$ and other ions, sensors configured for hydrocarbon analysis, CNT-, DLC-based sensors that operate with chemical electropotential, and sensors configured for carbon/oxygen analysis. Some embodiments of the sensor 105 may include a small source of a radioactive material and at least one of a gamma ray sensor or a neutron sensor.

In some embodiments, the sensor 105 may include acoustic sensors configured for acoustic imaging of the earth formation. Acoustic sensors may include thin films or piezoelectric elements. The sensor 105 may include other sensors such as pressure sensors, temperature sensors, stress sensors and/or strain sensors. For example, pressure sensors may include quartz crystals embedded within the substrate base 120 of the cutting element 100. Piezoelectric materials may be used for pressure sensors. Temperature sensors may include electrodes provided on or within the cutting element 100, wherein the electrodes are configured to perform resistivity and capacitive measurements that may be converted to other useful data.

In one embodiment, the sensor 105 of a plurality of cutting elements 100 may be configured as electrodes through which an electrical stimulus may be transmitted and received through the rock formation. Such an electrical stimulus may be used to determine information about the rock formation, such as the resistivity of the rock formation.

An example of using sensors 105 as electrodes is described in U.S. Provisional Patent Application No. 61/623,042, filed on Apr. 11, 2012, and entitled "Apparatuses and Methods for At-Bit Resistivity Measurements for an Earth-Boring Drilling Tool," the entire disclosure of which is incorporated herein by this reference.

In some embodiments, the sensor 105 may include one or more magnetic sensors that are configured for failure magnetic surveys. Those of ordinary skill in the art having benefit of the present disclosure would recognize that magnetic material may need to be magnetized or re-magnetized after being integrated into the cutting element 100.

In some embodiments, the sensor 105 may include a piezoelectric transducer that is configured to generate acoustic vibrations. Such an ultrasonic transducer may also be referred to as a vibrator. Such an ultrasonic transducer may be used to keep the face of cutting element 100 clean and to increase the drilling efficiency. In addition, the ability to generate elastic waves in the formation can provide much useful information. For example, a first transducer in a first cutting element 100 of an earth-boring drill bit may generate a shear wave propagating through the formation. The shear wave may be detected by a second transducer in a second cutting element 100 of the earth-boring drill bit, wherein the second transducer is separated from the first transducer by a known distance. The travel time for the shear wave to propagate through the formation may be used to measure shear velocity of the formation, which may be a good diagnostic of the rock type of the formation. Measurement of the decay of the shear wave over a plurality of distances may provide an additional indication of the rock type of the formation. In some embodiments, compressional wave velocity measurements are also made. The ratio of compressional wave velocity to shear wave velocity ($v_P/v_S$ ratio) may help to distinguish between carbonate rocks and siliciclastic rocks. The presence of gas can also be detected using measurements of the $v_P/v_S$ ratio. In some embodiments, the condition of the cutting element 100 may be determined from the propagation velocity of surface waves on the cutting element 100. This is an example of a determination of an operating condition of the earth-boring drill bit.

In some embodiments, the cutting element 100 may include diamond sensors that are configured for providing environmental information such as temperature and pressure of the cutting element 100 during drilling operations. Examples of such diamond sensors are described in U.S. Provisional Patent Application Ser. No. 61/418,217, which was filed on Nov. 30, 2010, and entitled "Cutter with Diamond Sensors for Acquiring Information Relating to an Earth-Boring Drilling Tool," the entire disclosure of which is incorporated herein by this reference.

In some embodiments, the cutting element 100 may include a sensor 105 that comprises a thermistor sensor including a thermistor material that changes resistivity in response to a change in temperature. Examples of such thermistor sensors and thermistor materials are described in U.S. patent application Ser. No. 13/093,284, which was filed on Apr. 25, 2011, now U.S. Pat. No. 8,746,367, issued Jun. 10, 2014, and entitled "Apparatus and Methods for Detecting Performance Data in an Earth-Boring Drilling Tool," the entire disclosure of which is incorporated herein by this reference.

The cutting element 100 may include a protective layer on a side of the cutting element covering the sensor 105. The protective layer may be a hardened layer configured to protect the sensor 105 from abrasion, erosion, impact, or other environmental factors existing in a wellbore. The protective layer may include a diamond film or other hard material. For example, the protective layer may be applied by chemical vapor deposition (CVD), physical vapor deposition (PVD), or other deposition techniques known to those of ordinary skill in art. Further, the sensor 105 may be disposed within a cavity formed in a mass of hard material, such as polycrystalline diamond, of cutting element 100. Such a cavity may be formed, for example, by electric discharge machining (EDM).

The sensor 105 may couple with a data processing unit 690, 790 (FIGS. 6 and 7) of the earth-boring drill bit 600, 700. For example, some earth-boring drill bits that include such an internal processing module may be termed a "Data Bit" module-equipped drill bit. Such a Data Bit may include electronics for obtaining and processing data related to the earth-boring drill bit, the drill bit frame, and operation of the earth-boring drill bit, such as is described in U.S. Pat. No. 7,604,072, issued Oct. 20, 2008, and entitled "Method and Apparatus for Collecting Drill Bit Performance Data," the entire disclosure of which is incorporated herein by this reference.

The cutting element 100 may further include metal traces and patterns for electrical circuitry associated with the sensor 105, and to communicate data to and from the sensor 105. Such metal traces and patterns may be similar to those described in U.S. patent application Ser. No. 13/093,326, which was filed on Apr. 25, 2011, now U.S. Pat. No. 8,695,729, issued Apr. 15, 2014, and entitled "PDC Sensing Element Fabrication Process and Tool," the entire disclosure of which is incorporated herein by this reference. Additional electrical circuitry and connectivity may be included, such as is described in U.S. patent application Ser. No. 13/093,289, which was filed on Apr. 25, 2011, now U.S. Pat. No. 8,757,291, issued Jun. 24, 2014, and entitled "At-Bit Evaluation of Formation Parameters and Drilling Parameters," the entire disclosure of which is incorporated herein by this reference.

By having the sensor 105 associated with the earth-boring drill bit (e.g., coupled with the cutting element 100), the time lag between the earth-boring drill bit penetrating the formation and the time the MWD/LWD tool senses a formation property or a drilling condition may be substantially reduced. In addition, by having the sensor 105 associated with the earth-boring drill bit, unsafe drilling conditions are more likely to be detected in substantially real time, providing an opportunity to take remedial action and avoid damage to the drill bit.

FIGS. 2A, 2B, 2C, and 2D are used to illustrate a method of forming an instrumented cutting element 200 according to an embodiment of the present disclosure. In particular, FIGS. 2A, 2B, 2C, and 2D show the cutting element 200 at various stages of formation of the instrumented cutting element. As discussed above, the cutting element 200 may be a conical cutting element that includes a substrate base 220 and a cutting tip 230.

Figure 2A:
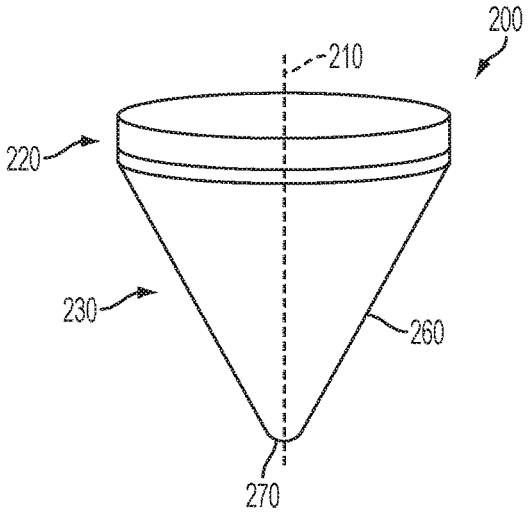
FIGS. 2A, 2B, 2C, and 2D are used to illustrate a method of forming an instrumented cutting element according to an embodiment of the present disclosure.

Referring to FIG. 2A shows the cutting element 200 may be formed without a sensor. The cutting element 200 may include a substrate base 220 and a cutting tip 230. The substrate base 220 may have a generally cylindrical shape. The cutting tip 230 includes a tapered surface 260 that tapers toward an apex 270 of the cutting tip 230. For example, the tapered surface 260 may be a generally conical surface, an ogive surface, or have another tapered shape. Thus, in some embodiments the apex 270 of the cutting tip 230 may be focused to a point, while in other embodiments the apex 270 of the cutting tip 230 may be generally rounded. The location of the apex 270 may be centered about a longitudinal axis 210 of the cutting element 200, such that the cutting element 200 may be substantially axi-symmetrical.

The cutting element 200 may be formed by sintering a diamond powder (cutting tip 230) with a tungsten-carbide substrate (substrate base 220) in a high-temperature high-pressure (HTHP) process. The diamond powder and the tungsten-carbide substrate may be together in a container that is placed in the HTHP press for undergoing the HTHP process. In some embodiments, the tungsten-carbide substrate may be formed by sintering a powder in the HTHP sintering process at the same time as the diamond powder is sintered to form the cutting tip 230 on the substrate base 220. After completion of the HTHP process, the cutting element 200 may be functional as a non-instrumented cutting element.

Figure 2B:
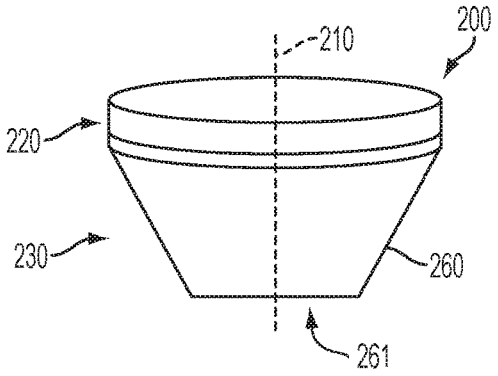

Referring to FIG. 2B, a portion of the cutting tip 230 of the cutting element 200 may be removed. For example, a portion of the cutting tip 230 may be removed, such that the cutting tip 230 may temporarily have a base portion 261 having a frustoconical shape. In some embodiments, the portion of the cutting tip 230 may be removed by cutting (e.g., laser cutting) the portion off of the cutting tip 230. In some embodiments, the cutting tip 230 may be formed as a base portion 261 having a frustoconical shape from the outset during the HTHP process.

Figure 2C:
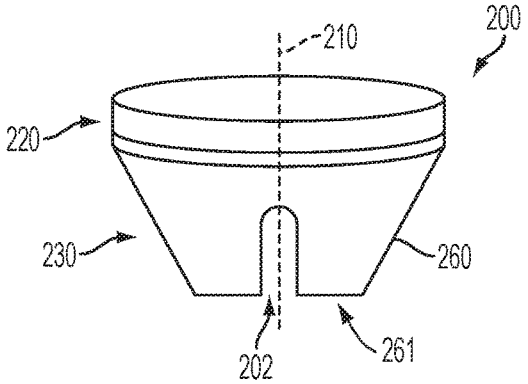

Referring to FIG. 2C, with the portion of the cutting tip 230 removed, another portion of the cutting tip 230 may be removed, such that a chamber 202 may be formed within the base portion 261 of the cutting tip 230. The chamber 202 may be formed along the longitudinal axis 210 and extend into the base portion 261 of the cutting tip 230. The chamber 202 may be formed by grinding, EDM, laser cutting, spark eroding, applying a hot metal solvent, and other similar methods. The chamber 202 may have a shape that is desired for housing a sensor 205 (FIG. 2D).

In another embodiment, the chamber 202 may be formed by providing a metal insert embedded within the cutting tip 230. The metal insert may be formed from a metal (e.g., nickel, titanium, etc.) that may survive the HTHP process. The metal insert may then be accessed and removed leaving the chamber 202 in the cutting tip 230. The metal insert may be removed by dissolving the metal after being made accessible.

Figure 2D:
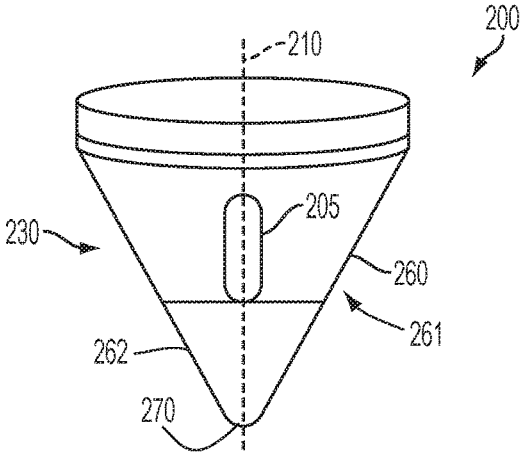

Referring to FIG. 2D, the sensor 205 may be disposed within the chamber 202 (FIG. 2C) of the cutting element 200, and a portion 262 of the cutting tip 230 that includes the apex 270 may be attached to the base portion 261 of the cutting tip 230. The sensor 205 may include one or more of the sensors discussed above with respect to FIGS. 1A, 1B, 1C. The portion 262 of the cutting tip 230 may be the same portion that was removed during the procedure described with respect to FIG. 2B, such that the portion 262 is re-attached to the base portion 261. In some embodiments the portion 262 of the cutting tip 230 may be a different portion, such as a newly formed portion attached to the base portion 261 of the cutting tip 230. Additional passageways (not shown) may be also formed in the cutting element 200 for the formation of conductive traces (e.g., wires) that may be used to transmit the signal from the sensor 205 to a data acquisition unit.

In some embodiments, the chamber 202 may be formed in the base portion 261 from the surface that attaches to the substrate base 220. In such embodiments, the cutting tip 230 may be removed from the substrate base 220 (e.g., by dissolving the tungsten-carbide material), such that the cutting tip 230 is a free-standing object in which the chamber 202 may be formed from the opposing surface from what is shown in FIG. 2C. In some embodiments, the cutting tip 230 may simply be formed initially as a free-standing object; however, removing the initial substrate base 220 may be used, in some embodiments, for instrumenting cutting elements 200 that have already been formed (e.g., retrofitting existing cutting elements). Further examples of forming sensors within a cutting element are described in U.S. patent application Ser. No. 13/586,650, which was filed on Aug. 15, 2012 and entitled "Methods for Forming Instrumented Cutting Elements of an Earth-Boring Drilling Tool," the entire disclosure of which is incorporated herein by this reference.

Figure 3:
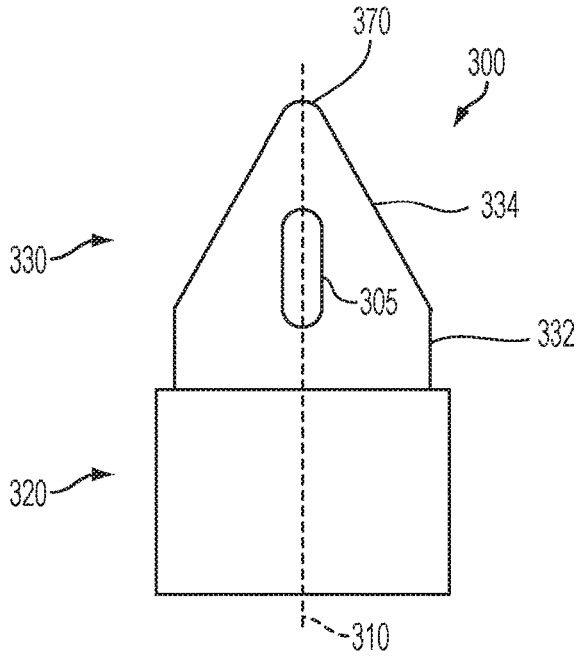
FIGS. 3, 4, and 5 are side views of cutting elements according to embodiments of the present disclosure.
Figure 4:
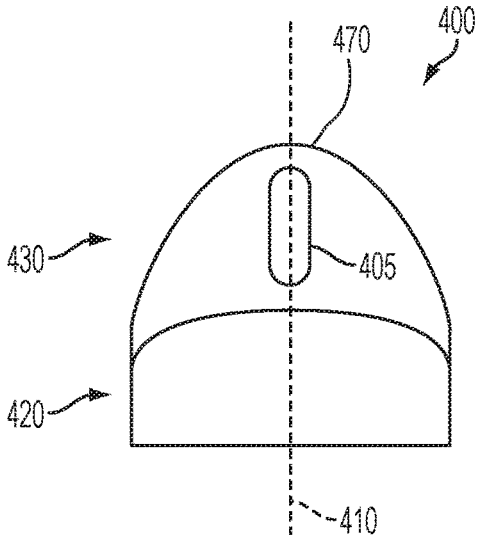
Figure 5:
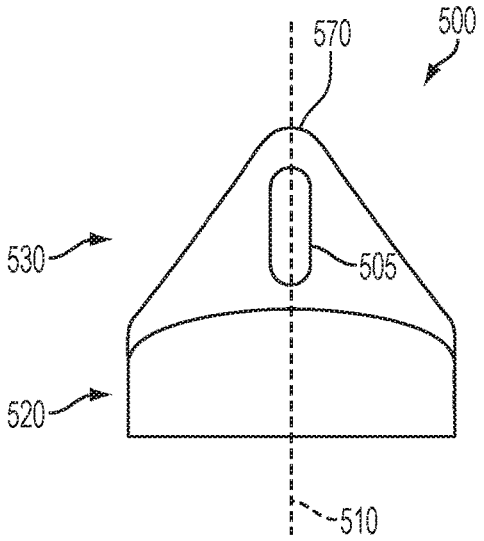

FIGS. 3, 4, and 5 are side views of cutting elements 300, 400, 500 according to embodiments of the present disclosure. Similar to the cutting element 100 of FIG. 1, the cutting elements 300, 400, 500 include a substrate base 320, 420, 520 and a cutting tip 330, 430, 530, respectively. The cutting tip 330, 430, 530 may have a tapered surface extending from the substrate base 320, 420, 520 and tapering to an apex 370, 470, 570 of the cutting tip 330, 430, 530. The cutting elements 300, 400, 500 may be axi-symmetrical about the longitudinal axis 310, 410, 510 of the cutting elements 300, 400, 500. The cutting elements 300, 400, 500 further include a sensor 305, 405, 505, which may be configured as discussed above. The substrate base 320, 420, 520 may include, for example, a cemented carbide material, such as a tungsten-carbide material. The cutting tip 330, 430, 530 may include a hard material, such as, for example, polycrystalline diamond, diamond-like carbon, or cubic boron nitride. The hard material may comprise substantially the entire cutting tip 330, 430, 530 or comprise a coating over another material, for example, a cemented carbide member protruding from the substrate base 320, 420, 520 and forming a portion thereof.

The tapered surfaces of the cutting tips 330, 430, 530 may have different shapes. Referring specifically to FIG. 3, the cutting element 300 may have a cutting tip 330 that includes a non-tapered portion 332 and a tapered portion 334. The apex 370 may be substantially flat, such that the tapered portion 334 may be a frustoconical shape. Referring specifically to FIG. 4, the cutting element 400 may have a cutting tip 430 that includes a tapered portion that is generally rounded as it tapers to the apex 470. The apex 470 may also be generally rounded. Referring specifically to FIG. 5, the cutting element 500 may have a cutting tip 530 that is focused to a point at the apex 570. In some embodiments, the cutting elements may incorporate a combination of one or more of the features described with reference to FIGS. 1A-1C, 3, 4, and 5.

Figure 6:
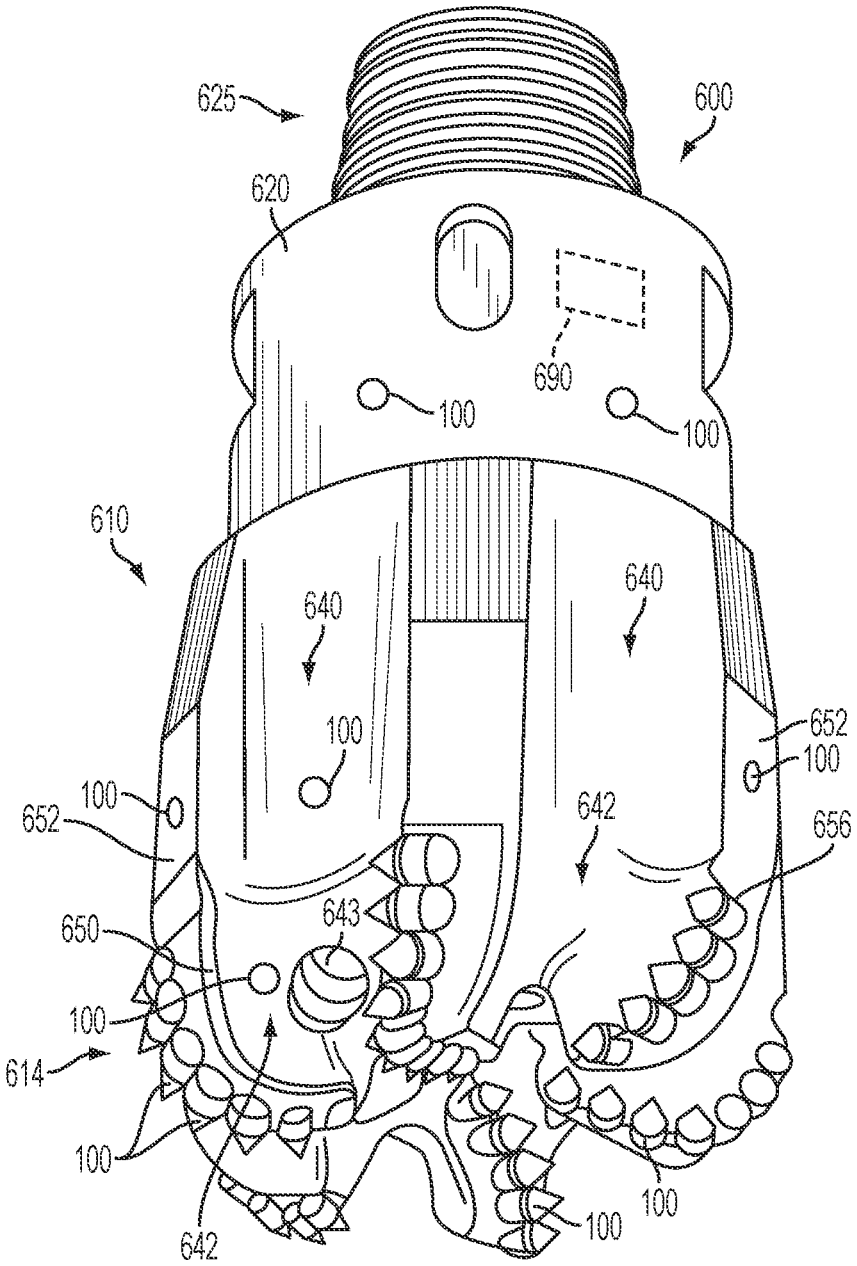
FIG. 6 is a perspective view of an earth-boring drill bit that may include sensor-enhanced cutting elements according to an embodiment of the present disclosure.

FIG. 6 is a perspective view of an earth-boring drill bit 600 that may include sensor-enhanced cutting elements according to an embodiment of the present disclosure. For example, the earth-boring drill bit 600 may include the cutting elements 100 of FIGS. 1A, 1B, and 1C. The earth-boring drill bit 600 includes a bit body 610. The bit body 610 may be formed from materials such as steel or a particle-matrix composite material. For example, the bit body 610 may include a crown 614 that includes a particle-matrix composite material such as, for example, particles of tungsten-carbide embedded in a copper alloy matrix material, or a cobalt-cemented tungsten carbide.

The earth-boring drill bit 600 may be secured to the end of a drill string (not shown), which may include tubular pipe and equipment segments (e.g., drill collars, a motor, a steering tool, stabilizers, etc.) coupled end to end between the earth-boring drill bit 600 and other drilling equipment at the surface of the formation to be drilled. As one example, the earth-boring drill bit 600 may be secured to the drill string with the bit body 610 being secured to a shank 620 having a threaded connection portion 625. The threaded connection portion 625 complementary engages with a threaded connection portion of the drill string. An example of such a threaded connection portion is an American Petroleum Institute (API) threaded connection portion.

The earth-boring drill bit 600 may include the cutting elements 100 attached to a face of the bit body 610. Examples of the cutting elements 100 are discussed with respect to FIGS. 1A, 1B, and 1C. The cutting elements 100 are discussed with reference to FIG. 6 (as well as FIGS. 7 and 8) for convenience, and it is recognized that cutting elements 200, 300, 400, or 500 may be also be used to replace the cutting elements 100 shown in FIGS. 6, 7, and 8. In addition, some embodiments may use any combination of cutting elements 100, 200, 300, 400, or 500 as the cutting elements shown in FIGS. 6, 7, and 8.

Referring again to FIG. 6, the cutting elements 100 may be provided along blades 650, such as within pockets 656 that are formed in the face of the bit body 610. The cutting elements 100 may be fabricated separately from the bit body 610 and secured within the pockets 656 formed in the outer surface of the bit body 610. A bonding material (e.g., adhesive, braze alloy, etc.) may be used to secure the cutting elements 100 to the bit body 610. The cutting elements 100 are attached to the bit body 610 in a fixed manner, such that the cutting elements 100 do not move relative to the bit body 610 during drilling. Thus, the earth-boring drill bit 600 may be a fixed-cutter drill bit.

The bit body 610 may further include junk slots 640 that separate gage pads 652 of the bit body 610. The gage pads 652 extend along the radial sides of the bit body 610. The bit body 610 may further include fluid courses 642 that separate the blades 650. The gage pads 652 of the bit body 610 couple with the blades 650, and the fluid courses 642 couple with the junk slots 640. The gage pads 652 and the blades 650 may be considered to protrude from the bit body 610. The fluid courses 642 and the junk slots 640 may be considered to be recessed into the bit body 610.

Internal fluid passageways 643 extend between the face of the bit body 610 and a longitudinal bore (not shown), which extends through the shank 620 and partially through the bit body 610. Nozzle inserts 844 (FIG. 8) also may be provided at the face of the bit body 610 within the internal fluid passageways 643. The nozzle inserts 844 may be configured to control the hydraulics of the earth-boring drill bit 600 during drilling operations.

During drilling operations, the earth-boring drill bit 600 is positioned at the bottom of a wellbore such that the cutting elements 100 are adjacent the earth formation to be drilled. Equipment such as a rotary table or a top drive may be used for rotating the drill string and the earth-boring drill bit 600 within the wellbore. In some embodiments, the shank 620 of the earth-boring drill bit 600 may be coupled directly to a drive shaft of a down-hole motor, which may be used to rotate the earth-boring drill bit 600. As the earth-boring drill bit 600 is rotated, drilling fluid is pumped to the face of the bit body 610 through the longitudinal bore and the internal fluid passageways 643. Rotation of the earth-boring drill bit 600 causes the cutting elements 100 to scrape across and shear away the surface of the underlying formation. The formation cuttings mix with, and are suspended within, the drilling fluid and pass through the junk slots 640 and the annular space between the wellbore and the drill string to the surface of the earth formation.

Figure 8:
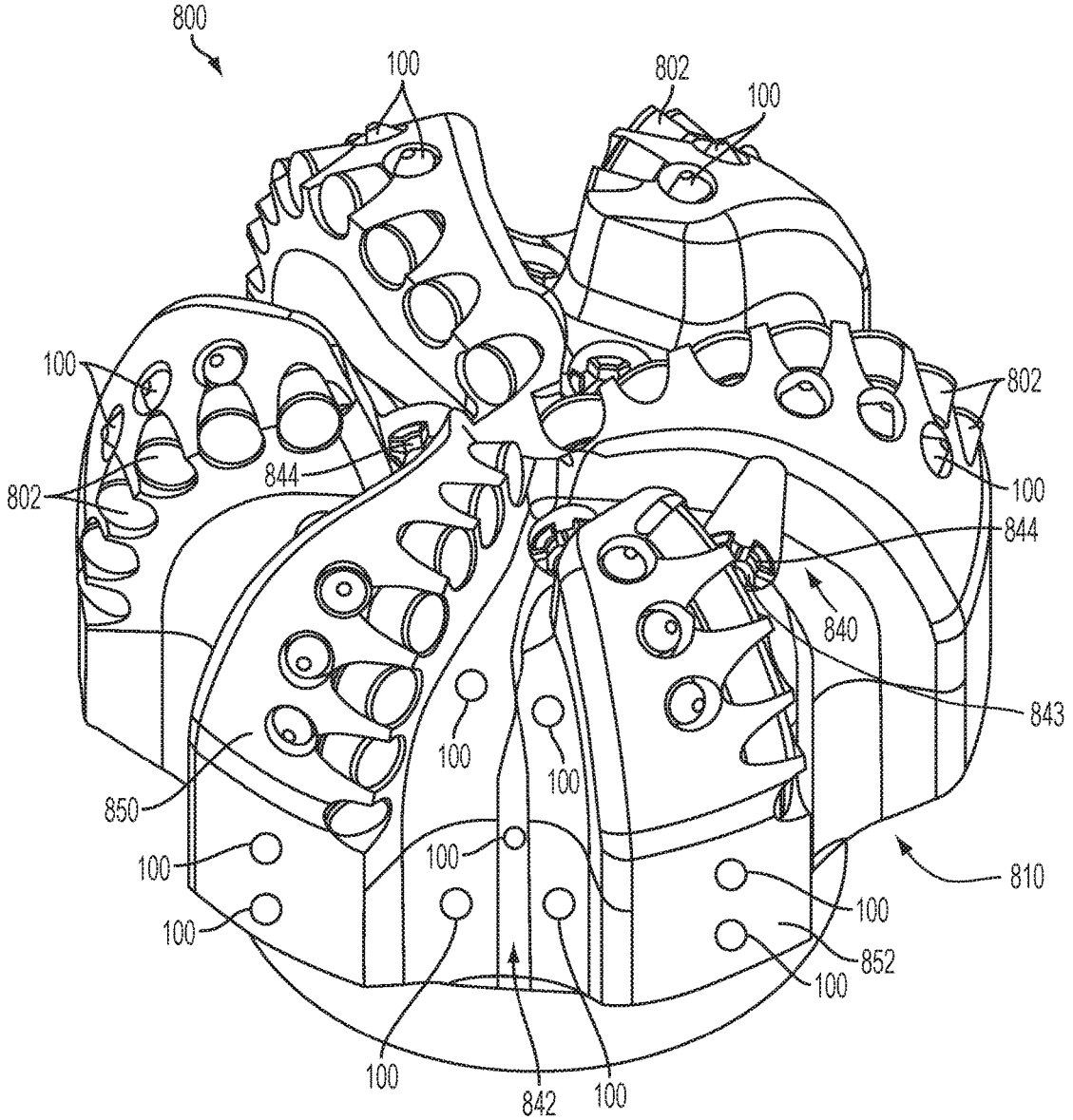
FIG. 8 is a perspective view of an earth-boring drill bit according to an embodiment of the present disclosure.

The cutting element 100 may be axi-symmetrical, such as along the longitudinal axis 110 (see FIGS. 1A-1C). By using cutting elements 100 having a tapered-shaped (e.g., conical) cutting tip 130 enabled with one or more sensors 105, the sensor 105 may have an improved signal-to-noise ratio for axial stresses because the symmetry of the tapered shaped cutting tip 130 may reduce torsional stresses experienced during unstable drilling. In other words, such tapered-shaped cutting elements 100 may be well suited to sensor applications because they may not be as susceptible to the same shear and torque that PDC cutters having a substantially planar cutting face and positioned for shear-type cutting in a drag bit may experience. Thus, the cutting elements 100 may be positioned at cutting areas of the earth-boring drill bit 600, such as on the cutting surfaces of the blades 650, or as back-up cutting elements 100 (FIG. 8).

In addition, the tapered shape (e.g., conical) cutting tip 130 may allow for the placement of the sensor-enhanced cutting elements 100 in non-cutting areas of the bit or downhole tooling without adversely affecting the stability or cutting dynamics as long as the exposure of the cutting elements 100 is properly controlled. In other words, the cutting elements 100 may have a reduced exposure in comparison to other cutting elements on a drill bit and exhibit some standoff distance from the formation during a drill operation so as not to engage in the primary cutting operations of the earth-boring drill bit 600. For example, the cutting elements 100 may be positioned at non-cutting areas that may be external locations of the earth-boring drill bit 600, such as the bit body 610, the shank 620, as well as other non-cutting locations of the BHA and drill string. As used herein, the terms "non-cutting location" and "non-cutting area" do not necessarily preclude cutting by a cutting element 100, but indicates that cutting of the formation is not substantial (for example, on the gage of a drill bit), or may occur only intermittently (for example, during certain drilling conditions, or during non-linear drilling).

Non-cutting areas of the bit body 610 may include non-cutting portions of the blades 650, the junk slots 640, the fluid courses 642, the gage pads 652, as well as other locations that where the cutting elements 100 may not be the primary cutting elements. At such non-cutting locations, the cutting elements 100 may have a reduced exposure and, so, are removed from substantially constant contact with the formation, if not an extremely reduced exposure to be removed from scraping or shearing contact with the formation. In other words, the cutting elements 100 may or may not protrude from the plane of the surface of the object to which the cutting element 100 is attached. As a result, the sensor 105 may retain the durability of being associated with a diamond part (i.e., cutting element 100), but may collect measurement data from a wider variety of locations than other types of sensors that may be embedded directly into the bit body 610.

In some embodiments, the sensor 105 may be configured to wirelessly transmit measurements to the data processing unit 690. For example, the sensor 105 may include a transmitter and the associated earth-boring drill bit 600 may include a receiver configured for wireless communication therebetween. For example, the receiver may be included within the bit body 610. The receiver may be configured to transmit the measurement data to devices in the shank 620 or a sub attached to the earth-boring drill bit 600. Such devices may be included as part of the Data Bit module.

Figure 7:
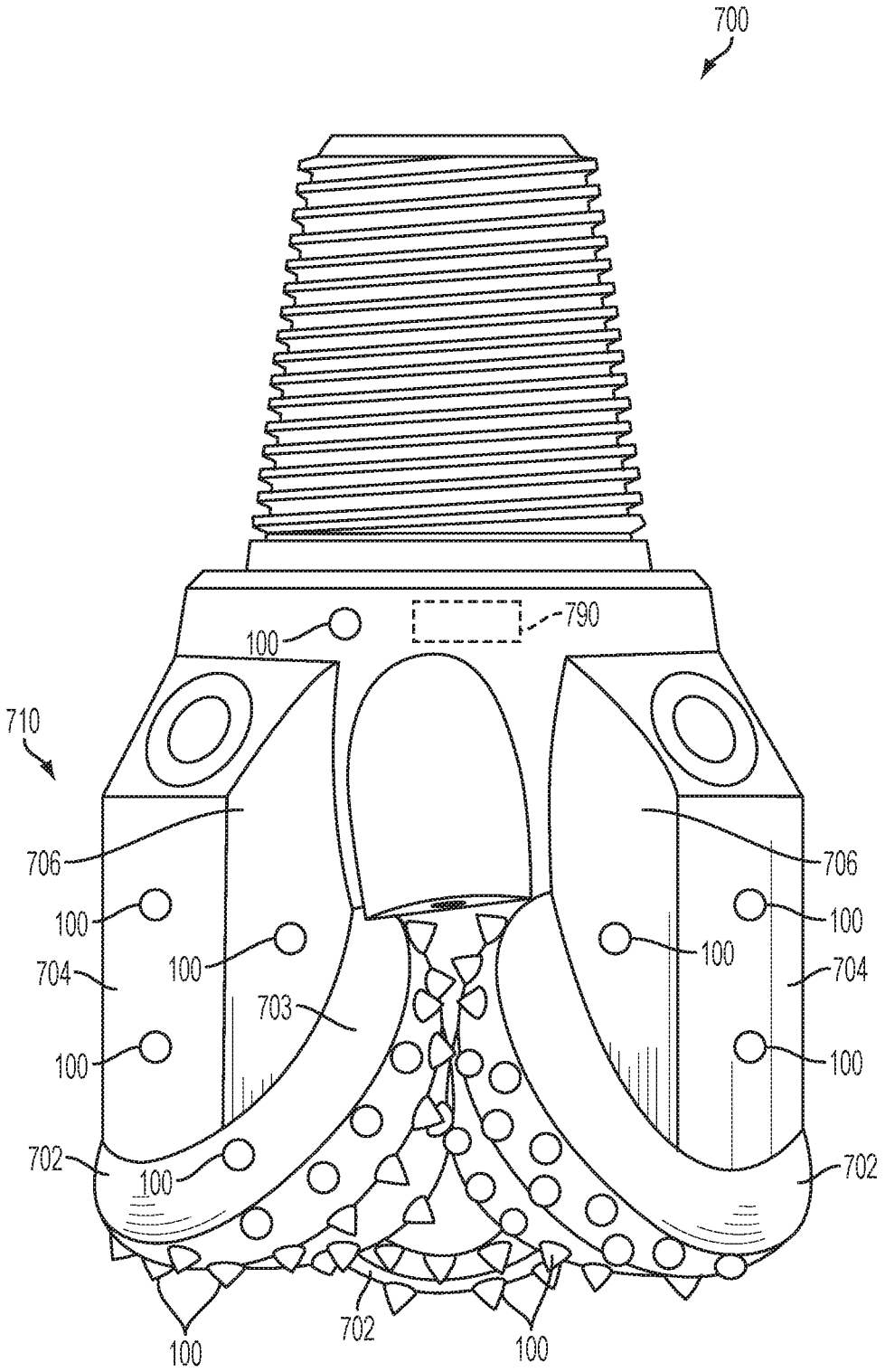
FIG. 7 is a side view of an earth-boring drill bit that may include sensor-enhanced cutting elements according to an embodiment of the present disclosure.

FIG. 7 is a side view of an earth-boring drill bit 700 that may include sensor-enhanced cutting elements according to an embodiment of the present disclosure. For example, the earth-boring drill bit 700 may include the cutting elements 100 of FIGS. 1A, 1B, and 1C. In particular, the earth-boring drill bit 700 is a rolling-cutter drill bit. Rolling cutter drill bits often include three roller cones 702 attached on supporting bit legs 704 that extend from a bit body 710. Each roller cone 702 is configured to spin or rotate on a bearing shaft that extends from the bit leg 704 in a radially inward and downward direction from the bit leg 704. The roller cones 702 may be formed from materials such as steel, a particle-matrix composite material (e.g., a cermet composite such as cemented tungsten-carbide), or other similar materials. The cutting elements 100 may be coupled with the roller cones 702. As the earth-boring drill bit 700 is rotated within a wellbore, the roller cones 702 roll and slide across the surface of the underlying formation, which causes the cutting elements 100 to crush and scrape away the underlying formation.

The cutting elements 100 shown in FIG. 7 may be positioned at locations of the earth-boring drill bit 700, such as at cutting locations and at non-cutting locations. Cutting locations may include the cutting surface of the roller cones 702, while non-cutting locations may include locations on the bit body 710 such as the bit leg 704, non-cutting surfaces (e.g., top surface 703) of the roller cones 702. Non-cutting locations of the bit leg 704 may include, for example, an outer surface of the leg 704 and an interior surface 706. In addition, non-cutting locations at which the cutting elements may be positioned may include locations on the drilling tool such as the shank, BHA, and drill string.

FIG. 8 is a perspective view of an earth-boring drill bit 800 according to an embodiment of the present disclosure. The earth-boring drill bit 800 is a fixed-cutter drill bit, which may be configured similarly to the earth-boring drill bit 600 of FIG. 6. For example, the earth-boring drill bit 800 may include the bit body 810, blades 850, fluid courses 842, gage pads 852, and junk slots 840, which may be configured generally as described with respect to FIG. 8. FIG. 8 shows the nozzle inserts 844 within the internal fluid passageways 843.

As shown in FIG. 8, the blades 850 may include cutting elements 802. The cutting elements 802 may be configured as PDC cutting elements that are generally cylindrical, and include a substrate and a diamond table. The cutting elements 802 may be the primary cutting elements of the earth-boring drill bit 800. The cutting elements 802 may be non-instrumented cutting elements that may be cylindrical, as shown in FIG. 8. In some embodiments, the cutting elements 802 may be instrumented cutting elements. In some embodiments, the cutting elements 802 may be replaced by the instrumented cutting elements 100.

The blades 850 may further include cutting elements 100 as described above with respect to FIGS. 1A, 1B, and 1C. The cutting elements 100 may be coupled with the blade 850 in a row behind the cutting elements 802. Thus, the cutting elements 100 may be configured as a row of back-up cutters that may scrape the formation in the event of a failure of one of the cutting elements 802 in the row of primary cutters. In order for the cutting elements 100 on the blades 850 to act as back-up cutters, the cutting elements 100 on the blades 850 may protrude from the blades 850 such that at least a portion of the cutting element 100 extends beyond the surface of the blade 850 in order to contact the formation during drilling operations. In other words, the cutting elements 100 configured to act as back-up cutters are configured in a cutting position.

The earth-boring drill bit 800 may further include cutting elements 100 that are positioned on the bit body 810 at non-cutting positions. For example, cutting elements 100 may be coupled with the bit body 810 at positions such as the gage pads 852, the junk slots 840, the fluid courses 842, the shank 620 (FIG. 6) and at non-cutting locations of the bit body 810. For example, the cutting elements 100 may be coupled on a back facing side of the blades 850. The cutting elements 100 may be located on other non-cutting positions of the downhole tooling, such as the BHA or drill string.

Depending on the location of the cutting elements 100 at non-cutting positions, the cutting elements 100 may or may not protrude from the surface of the bit body 810 or other location in the drill string or other tool string. For example, the cutting elements 100 may have some standoff distance from the formation such that the cutting elements 100 may at least partially protrude from the surface without effective exposure to contact with the formation. For example, because junk slots 840 already may be somewhat recessed relative to the blades 850 or because the fluid courses 842 may be recessed relative to the gage pads 852, coupling the cutting elements 100 within such regions of the bit body 810 may at least partially protrude from the surface thereof. Of course, in some embodiments the cutting elements 100 may still be flush with the surface of such regions, or partially recessed into the surface of such regions, if desired.

For embodiments where the cutting element 100 is desired at a non-cutting position, but that a protruding cutting element 100 would have exposure to the formation, the cutting element may be flush with the surface of such regions, or at least partially recessed into the surface of such regions. For example, the cutting elements 100 coupled with the gage pads 852 of the bit body 810 may be flush with or recessed into the radially outer surface of the gage pads 852, otherwise the cutting elements 100 would be in a cutting position that may affect the stability or cutting dynamics of the earth-boring drill bit 800.

Although FIGS. 6, 7, and 8 are specifically shown as examples of the cutting elements 100 being implemented with a fixed-cutter bit (FIGS. 6 and 8) or a roller cone bits (FIG. 7), embodiments of the present disclosure may further include other bits, including hybrid bits, impregnated bits, along with the other bits described above.

Additional non-limiting embodiments are described below:

Embodiment 1: A sensor-enabled cutting element for an earth-boring drilling tool, the sensor-enabled cutting element comprising: a substrate base; a cutting tip at an end of the substrate base, the cutting tip comprising a tapered surface extending from the substrate base and tapering to an apex of the cutting tip; and a sensor coupled with the cutting tip, wherein the sensor is configured to obtain data relating to at least one parameter related to at least one of a drilling condition, a wellbore condition, a formation condition, and a condition of the earth-boring drilling tool.

Embodiment 2: The sensor-enabled cutting element of Embodiment 1, wherein the apex of the cutting tip is centered about a longitudinal axis of the cutting tip.

Embodiment 3: The sensor-enabled cutting element of Embodiment 1 or Embodiment 2, wherein the at least one parameter includes at least one of temperature, pressure, strain, stress, and resistivity.

Embodiment 4: The sensor-enabled cutting element of any of Embodiments 1 through 3, wherein the cutting tip includes a hard material selected from the group consisting of polycrystalline diamond, diamond-like carbon, and cubic boron nitride.

Embodiment 5: The sensor-enabled cutting element of any of Embodiments 1 through 4, wherein the substrate base includes a tungsten-carbide material.

Embodiment 6: The sensor-enabled cutting element of any of Embodiments 1 through 5, wherein the sensor includes at least one of a transducer, a piezoelectric material, an acoustic sensor, a pressure sensor, a temperature sensor, a stress sensor, and a strain sensor.

Embodiment 7: The sensor-enabled cutting element of any of Embodiments 1 through 6, wherein the sensor is configured to measure physical properties of the sensor-enabled cutting element.

Embodiment 8: The sensor-enabled cutting element of Embodiment 7, wherein the sensor includes at least one of an accelerometer, a gyroscope, an inclinometer, a micro-electromechanical system (MEMS), and a nanoelectromechanical system (NEMS).

Embodiment 9: The sensor-enabled cutting element of any of Embodiments 1 through 8, wherein the sensor includes a chemical sensor configured to perform elemental analysis of the wellbore condition.

Embodiment 10: The sensor-enabled cutting element of Embodiment 9, wherein the sensor includes at least one of a carbon nanotube, a complementary-metal oxide semiconductor sensor, a sensor configured to perform a hydrocarbon analysis, and a sensor configured to perform a carbon/oxygen analysis.

Embodiment 11: The sensor-enabled cutting element of any of Embodiments 1 through 10, wherein the sensor includes a radioactive material and at least one of a gamma ray sensor and a neutron sensor.

Embodiment 12: The sensor-enabled cutting element of any of Embodiments 1 through 11, wherein the sensor is configured as an electrode to transmit an electrical stimulus.

Embodiment 13: The sensor-enabled cutting element of any of Embodiments 1 through 12, wherein the sensor includes at least one of a magnetic sensor and a thermistor sensor.

Embodiment 14: An earth-boring drilling tool, comprising: a body; and at least one cutting element coupled with the body, the at least one cutting element including: a cutting tip at an end of the substrate base, the cutting tip comprising a tapered surface extending from the substrate base and tapering to an apex of the cutting tip; and a sensor coupled with the cutting tip, wherein the sensor is configured to obtain data relating to at least one parameter associated with at least one of a drilling condition, a wellbore condition, a formation condition, and diagnostic performance of at least one component of the earth-boring drilling tool.

Embodiment 15: The earth-boring drilling tool of Embodiment 14, wherein the sensor is embedded within the cutting tip.

Embodiment 16: The earth-boring drilling tool of Embodiment 14 or Embodiment 15, wherein the at least one cutting element is coupled with the body at a cutting location of the earth-boring drilling tool.

Embodiment 17: The earth-boring drilling tool of Embodiment 16, wherein the cutting location is a cutting surface on a blade of a fixed-cutter earth-boring tool.

Embodiment 18: The earth-boring drilling tool of Embodiment 16, wherein the cutting location is a cutting surface of a roller cone of an earth-boring tool.

Embodiment 19: The earth-boring drilling tool of any of Embodiments 14 through 16, wherein the cutting element is coupled with the body at a non-cutting location of the earth-boring drilling tool.

Embodiment 20: The earth-boring drilling tool of Embodiment 19, wherein the non-cutting location is a location of at least one of a bottom-hole assembly and a drill string.

Embodiment 21: The earth-boring drilling tool of Embodiment 19, wherein the non-cutting location is at least one of a gauge pad, a junk slot, a fluid course, and a shank of an earth-boring drill bit.

Embodiment 22: The earth-boring drilling tool of any of Embodiments 14 through 21, wherein the apex of the at least one cutting element at least partially protrudes from a surface of the body.

Embodiment 23: The earth-boring drilling tool of any of Embodiments 14 through 21, wherein the apex of the at least one cutting element is recessed below a surface of the body.

Embodiment 24: A method of forming a sensor-enabled cutting element of an earth-boring drilling tool, the method comprising: forming a cutting element having a substrate base and a conical cutting tip, the conical cutting tip having a lateral surface that tapers from the substrate base to an apex; and coupling a sensor to the conical cutting tip.

Embodiment 25: The method of Embodiment 24, wherein forming the cutting element includes: forming a fully functional non-instrumented cutting element; removing a portion of the non-instrumented cutting element; forming a chamber within the cutting tip by removing another portion of the cutting tip from a surface of the cutting tip that was exposed by removing the portion; and inserting the sensor within the chamber.

Embodiment 26: The method of Embodiment 25, wherein removing the portion includes removing the substrate base from the cutting tip.

Embodiment 27: The method of Embodiment 25, wherein removing the portion includes cutting off a portion of the cutting tip that includes the apex.

Embodiment 28: The method of Embodiment 27, further comprising re-attaching the portion of the cutting tip that includes the apex after inserting the sensor within the chamber.

Embodiment 29: The method of any of Embodiments 24 through 28, wherein forming the cutting element includes forming the apex to have a shape selected from a point or rounded.

While the present disclosure has been described herein with respect to certain embodiments, those of ordinary skill in the art will recognize and appreciate that it is not so limited. Rather, many additions, deletions and modifications to the described embodiments may be made without departing from the scope of the disclosure as hereinafter claimed, including legal equivalents. In addition, features from one embodiment may be combined with features of another embodiment while still being encompassed within the scope of the disclosure as contemplated by the inventor.

What is claimed is:

1. A sensor-enabled cutting element for an earth-boring drilling tool, the sensor-enabled cutting element comprising:

a substrate base;

a cutting tip at an end of the substrate base, the cutting tip comprising a tapered surface extending from the substrate base and tapering to an apex of the cutting tip centered about a longitudinal axis of the cutting tip; and a sensor embedded within the cutting tip, surrounded by the cutting tip, and aligned with the longitudinal axis of the cutting tip, wherein the sensor is configured to obtain data relating to at least one parameter related to at least one of a drilling condition, a wellbore condition, a formation condition, and a condition of the earth-boring drilling tool.

2. The sensor-enabled cutting element of claim 1, wherein the at least one parameter includes at least one of temperature, pressure, strain, stress, and resistivity.

3. The sensor-enabled cutting element of claim 1, wherein the cutting tip includes a hard material selected from the group consisting of polycrystalline diamond, diamond-like amorphous carbon, and cubic boron nitride.

4. The sensor-enabled cutting element of claim 1, wherein the substrate base includes a tungsten-carbide material.

5. The sensor-enabled cutting element of claim 1, wherein the sensor includes at least one of a transducer, a piezoelectric material, an acoustic sensor, a pressure sensor, a temperature sensor, a stress sensor, and a strain sensor.

6. The sensor-enabled cutting element of claim 1, wherein the sensor is configured to measure physical properties of the sensor-enabled cutting element.

7. The sensor-enabled cutting element of claim 6, wherein the sensor includes at least one of an accelerometer, a gyroscope, an inclinometer, a microelectromechanical system (MEMS), and a nanoelectromechanical system (NEMS).

8. The sensor-enabled cutting element of claim 1, wherein the sensor includes a chemical sensor configured to perform elemental analysis of the wellbore condition.

9. The sensor-enabled cutting element of claim 8, wherein the sensor includes at least one of a carbon nanotube, a complementary metal oxide semiconductor sensor, a sensor configured to perform a hydrocarbon analysis, and a sensor configured to perform a carbon/oxygen analysis.

10. The sensor-enabled cutting element of claim 1, wherein the sensor includes a radioactive material and at least one of a gamma ray sensor and a neutron sensor.

11. The sensor-enabled cutting element of claim 1, wherein the sensor is configured as an electrode to transmit an electrical stimulus.

12. The sensor-enabled cutting element of claim 1, wherein the sensor includes at least one of a magnetic sensor and a thermistor sensor.

13. The sensor-enabled cutting element of claim 1, wherein the tapered surface of the cutting tip includes a flat portion relative to a rest of the tapered surface of the cutting tip.

14. An earth-boring drilling tool, comprising:

a body; and at least one cutting element coupled with the body at a cutting location of the earth-boring drilling tool, the at least one cutting element including:

a cutting tip at an end of a substrate base, the cutting tip comprising a tapered surface extending from the substrate base and tapering to an apex of the cutting tip; and a sensor embedded within a chamber of the cutting tip, the chamber entirely enclosed by the cutting tip, defined along a central longitudinal axis of the at least one cutting element, and aligned with the apex of the cutting tip, wherein the sensor is configured to obtain data relating to at least one parameter associated with at least one of a drilling condition, a wellbore condition, a formation condition, and diagnostic performance of at least one component of the earth-boring drilling tool.

15. The earth-boring drilling tool of claim 14, wherein the cutting location is a cutting surface on a blade of a fixed-cutter earth-boring tool.

16. The earth-boring drilling tool of claim 14, wherein the cutting location is a cutting surface of a roller cone of an earth-boring tool.

17. The earth-boring drilling tool of claim 14, further comprising another cutting element having another cutting tip and another sensor configured the same as the at least one cutting element, wherein the another cutting element is coupled with the body at a non-cutting location of the earth-boring drilling tool.

18. The earth-boring drilling tool of claim 17, wherein the non-cutting location is one of a bottom-hole assembly, a drill string, a gauge, a junk slot, a fluid course, and a shank of an earth-boring drill bit.

19. The earth-boring drilling tool of claim 14, wherein the apex of the at least one cutting element at least partially protrudes from a surface of the body.

20. The earth-boring drilling tool of claim 14, wherein the apex of the at least one cutting element is recessed below a surface of the body.

* * * * *